US005361124A

United States Patent [19]

Rowe et al.

[11] Patent Number: 5,361,124

[45] Date of Patent: Nov. 1, 1994

[54] TEMPERATURE CONTROL SYSTEM FOR A FUSER

[75] Inventors: Paul J. Rowe, Williamson; Paul M. Achtziger, Ontario; David C. Malecki, Rochester; Nicholas Kladias, Woodside, all of N.Y.

[73] Assignee: Xerox Corporation, Stamford, Conn.

[21] Appl. No.: 126,442

[22] Filed: Sep. 23, 1993

Related U.S. Application Data

[63] Continuation of Ser. No. 888,947, May 26, 1992, abandoned.

[51] Int. Cl.[5] ..... G03G 21/00

[52] U.S. Cl. ..... 355/208; 219/216; 355/282

[58] Field of Search ..... 355/285, 282, 208, 311; 219/216, 469–471

[56] References Cited

U.S. PATENT DOCUMENTS

| | | | |
|---|---|---|---|
| 4,075,455 | 2/1978 | Kitamura et al. | 219/216 |
| 4,821,974 | 4/1989 | Poehlein | 242/68.4 |
| 4,825,242 | 4/1989 | Elter | 219/216 |
| 4,996,556 | 2/1991 | Gray, Jr. | 355/311 |
| 5,040,777 | 8/1991 | Bell et al. | 271/3 |

FOREIGN PATENT DOCUMENTS

| | | |
|---|---|---|
| 1-149081 | 6/1989 | Japan . |
| 3-18883 | 1/1991 | Japan . |
| 3-172881 | 7/1991 | Japan . |

*Primary Examiner*—Matthew S. Smith
*Assistant Examiner*—Shuk Y. Lee

[57] ABSTRACT

An improved fuser system especially effective for a large document type of copier is provided. The fusing system is of the heat and pressure type wherein a fuser roll is internally heated by a lamp so that the fuser surface is at a required fusing temperature. When the full width of the roll is used in a particular fusing operation, e.g. 36" wide documents are being copied, the lamp is heated to a maximum temperature. When the document copy is less than 36" and for a center registered system, the ends of the fuser roll would tend to overheat, since the copy media is absorbing heat only in the center portion. According to one aspect of the invention, a control circuit is provided to recognize that the shorter widths of the copy media are being used and to lower the lamp temperature in response thereto to prevent the fuser roll ends from overheating. A further concept is to recognize the type of media being used and to lower the lamp temperature in response to selection of copy media of different fusing characteristics.

2 Claims, 4 Drawing Sheets

CONTROL PANEL

TEMPERATURE CONTROL SYSTEM FOR A FUSER

This is a continuation of application Ser. No. 07/888,947, filed May 26, 1992, now abandoned.

This invention relates generally to a fuser used in an electrophotographic printing machine and, more particularly, to a control system for selectively changing the temperature of a heated fuser roll in response to changes in the characteristics of the copy media.

Generally, the process of electrophotographic printing includes charging a photoconductive member to a substantially uniform potential so as to sensitize the surface thereof. The charged portion of the photoconductive surface is exposed to a light image of an original document being reproduced, thereby recording an electrostatic latent image on the photoconductive surface. The latent image is then developed forming a toner powder image on the photoconductive surface which is subsequently transferred to a copy sheet. Finally, the toner powder image is heated to permanently fuse it to the copy sheet in image configuration.

One preferred fusing method is to provide a heated fuser roll with a back-up roll or a biased web member in pressure contact therewith. The copy media passes through the nip defined by the heated roll and biased roller or web to heat the toner powder image and fuse it to the copy sheet. Typically, the heated roll is heated by applying power to a heating element located internally within the fuser roll which extends the width of the fuser roll. The heat from the lamp is transferred to the fuser roll surface along the fusing area. Quartz lamps have been preferred for the heating element.

A significant problem in prior art heated fuser roll systems is the temperature variations of the heat transferred to the fuser roll surface, due to changes in the characteristics of the copy media during extended copy runs. The problem is especially significant when the printing machine is a large document copier, such as the Xerox 2510, 2520, in which a variety of copy media, such as bond, vellum or film are used to copy documents having widths extending from 8.5 inches up through 36 inches. The temperature variations which occur when the copy media have widths less than the width of the fuser roll arises from the fact that the end areas of the fuser roll will tend to overheat, since the copy media, in a center registered system, passes along the center areas of the fuser roll absorbing heat from the central area but allowing the end areas to overheat. This can result in offsetting of subsequent copies. A second factor relates to different fusing characteristics of the copy media. Bond media has a high moisture content and requires processing at a higher temperature when compared, for example, with vellum and film, which have significant differences in fusing characteristics and require a lower operating temperature. It would be very desirable to provide a heated fuser system which is able to optimize performance with any combination of copy media used and copy width selected.

In the prior art, there have been tradeoffs involved in each of these selections. Typically, the fuser system is operated at one standard temperature, which may be lower than optimum for certain type of media widths and slightly higher than optimum for narrower width media.

There have been numerous techniques developed in the prior art for compensating for this temperature variation. U.S. Pat. No. 4,825,242 discloses one technique which uses several heating lamps internal to a fusing roll and includes a control system which selectively energizes the lamp during a copy run and turning the fuser off on alternate copies made during the run. This patent also lists other prior art solutions to the fuser roll overheating problem.

The present invention is directed towards a solution to the overheating problem which utilizes a control system which changes the operating temperature of a single internal heating lamp located internally to a fuser roll, in response to changes in the type of output media selected and to changes in the width of the document being copied, as reflected in the width of the copy media. The temperature changes are designed to lower the temperature when documents less than maximum width are being copied, and also when the copy media used requires a lower fusing temperature, such as use of a vellum or film. More particularly, the present invention relates to an apparatus for fusing an image to a plurality of copy media of differing types and widths, said copy media having different fusing characteristics including:

means for applying heat to a fusing member, means for applying pressure contact between said copy media and said fusing member so as to fuse said image, means for generating electrical signals representing the type of copy media and the width of the copy media selected, and means for controlling said heat applying means in response to said electrical signals so as to selectively vary said applied heat in response to changes in said selected copy media or width.

Figure 1:
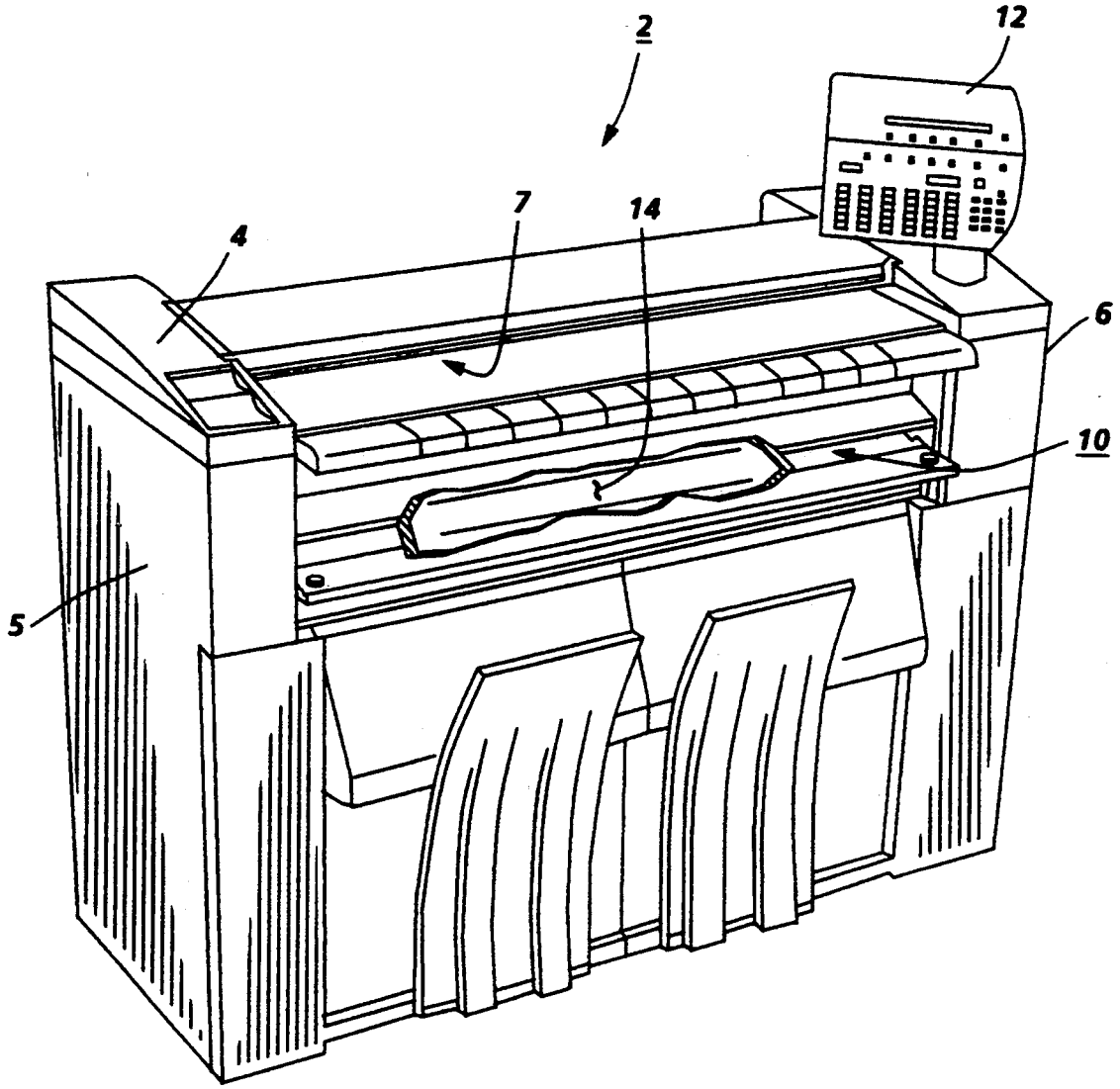
FIG. 1 is a front perspective view of a large document copier incorporating the fuser temperature control system of the present invention.

FIG. 1 shows a front perspective view of a large document copier which incorporates the fuser temperature control system of the present invention. The copier 2 includes a housing frame 4, having panels 5 and 6, which enclose the sides of frame 4. Documents are fed into an entry nip 7, either by a constant velocity transport (CVT) feeder or manually by an operator. Located within the frame 4 are xerographic subassemblies used to create an output copy of the original document. These include an exposure station to form an electrostatic latent image of the document on the surface of a photoreceptor drum; a charging station to charge the surface of the drum; a developing station to develop the latent image; a transfer station to transfer the developed image to a copy sheet and a fusing station to fuse the transferred image. The fusing station incorporates an exemplary heat and fusing system 10, which includes an elongated fuser roll 14, located within machine frame 4, as shown in the cutaway view. A control panel 12 contains the switches for selecting the number of copies to be printed, the type of copy media, the width of the copying media, etc., as disclosed in further detail below. Further details of the exemplary system in which the above subassemblies and the fusing system of the present invention can be used are disclosed in U.S. Pat. Nos.

5,040,777; 4,821,974 and 4,996,556, whose contents are hereby incorporated by reference.

Figure 2:
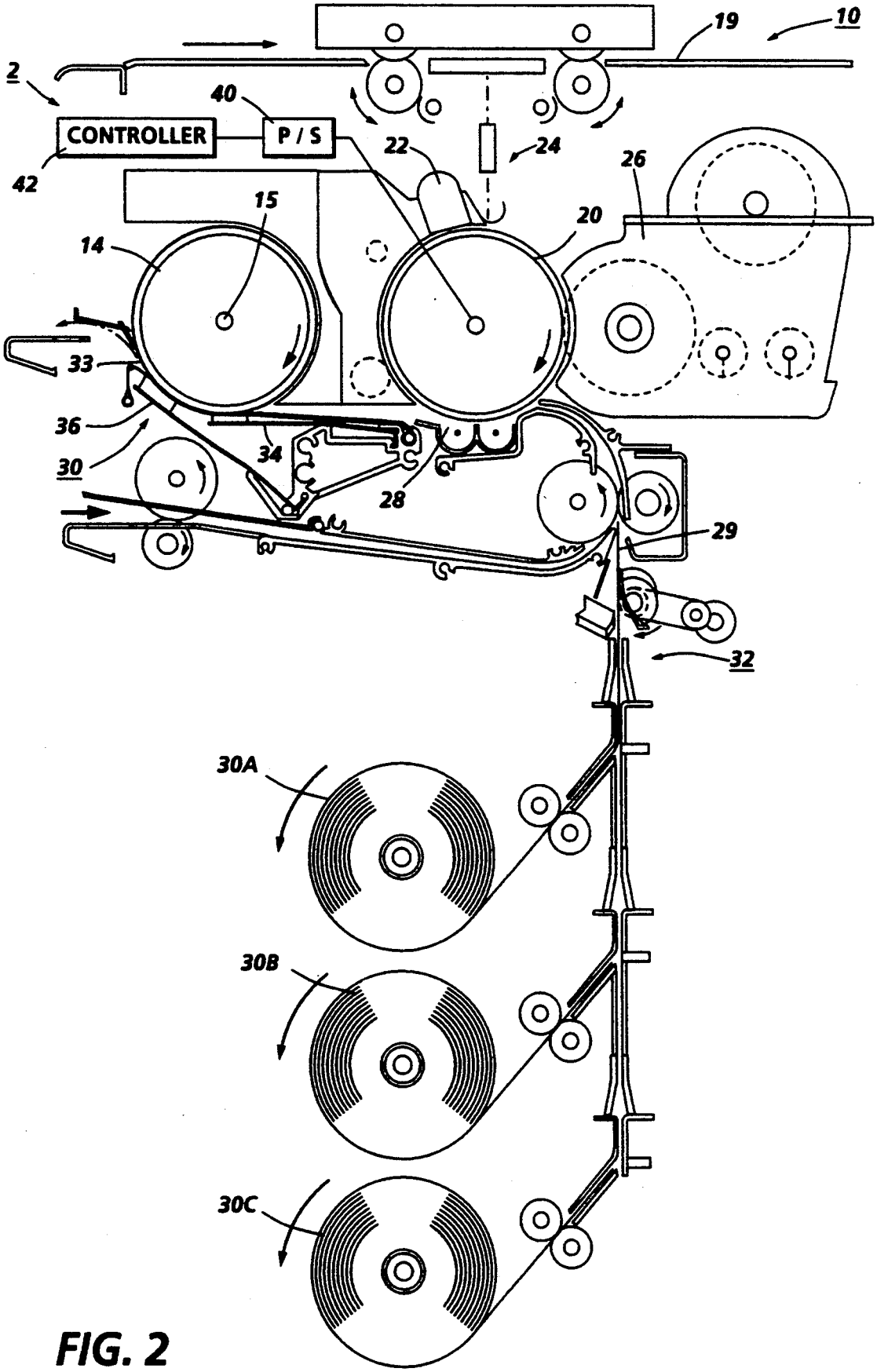
FIG. 2 is a side schematic view of the copier of FIG. 1.

FIG. 2 shows a side internal view of the copier 2. Copier 2 includes an electrostatic drum 20 with xerographic stations arranged about its periphery, which carry out the operational steps of the copying process. These stations include charging station 22, exposure station 24, developing station 26 and transfer station 28. Documents fed along the platen 19 in the direction of the arrow are imaged onto the surface of drum 20, at exposure station 24.

Copier 10 incorporates a multi-media option by providing three different types of copy media in roll form. Rolls 30A, 30B, 30C may constitute a bond, vellum and film media, respectively. The rolls may be of different widths corresponding to the widths of the documents being copied. The type of media and the width of the copy media is selected by an operator at control panel 12, as will be seen. The media cutting operation is performed at cutting station 32 and a copy media 29 is advanced into the transfer station 28, where the developed image is transferred to the sheet. Copy media 29, which is center registered, is advanced into the fusing system 30. The leading edge enters a nip formed by the fuser roll 14 and a heat resistant web 33, which is biased into contact along a portion of the surface of roll 14, by two flexible biasing blade members 34, 36. It is understood that a backup bias roller could be used instead of the web member 32 to provide the fusing area.

Fuser roll 14 has a length into the page; all components of the system likewise extend into the page and are commensurate in length with the fuser roll. Fuser roll 14, in a preferred embodiment, comprises a thin-walled thermally conductive tube having a thin (i.e. approximately 0.005 inch (0.01 Centimeters)) coating of silicone rubber on the exterior surface thereof, which contacts the image on the copy media to thereby affix the image to the media. Fuser roll 14 is heated by an internal heating source, for this embodiment, quartz lamp 15. A release agent management system, not shown, applies a thin layer of silicone oil to the surface of the fuser roll for the prevention of toner offset thereto, as well as reducing the torque required to effect rotation of the fuser roll. In one operative embodiment of the invention, the fuser roll has a diameter of 3.3 inches and a length of 40 inches. This embodiment is typically used to fuse images on copy substrates that are up to 3 feet (0.91 meters) wide by 4 feet (1.22 meters) in length.

Turning now to the operation of lamp 15, power is applied thereto by power supply 40 under control of system controller 42. Power supply 40 is a pulse transformer gated triac which switches AC line power to the fuser lamp. The gate is directly controlled by the control firmware. System controller 42 will vary the output of supply 40 and hence change the operating temperature of lamp 15, in response to selections at control panel 12 made by an operator, when selecting the type of copy media and the width of the copy media.

Figure 3:
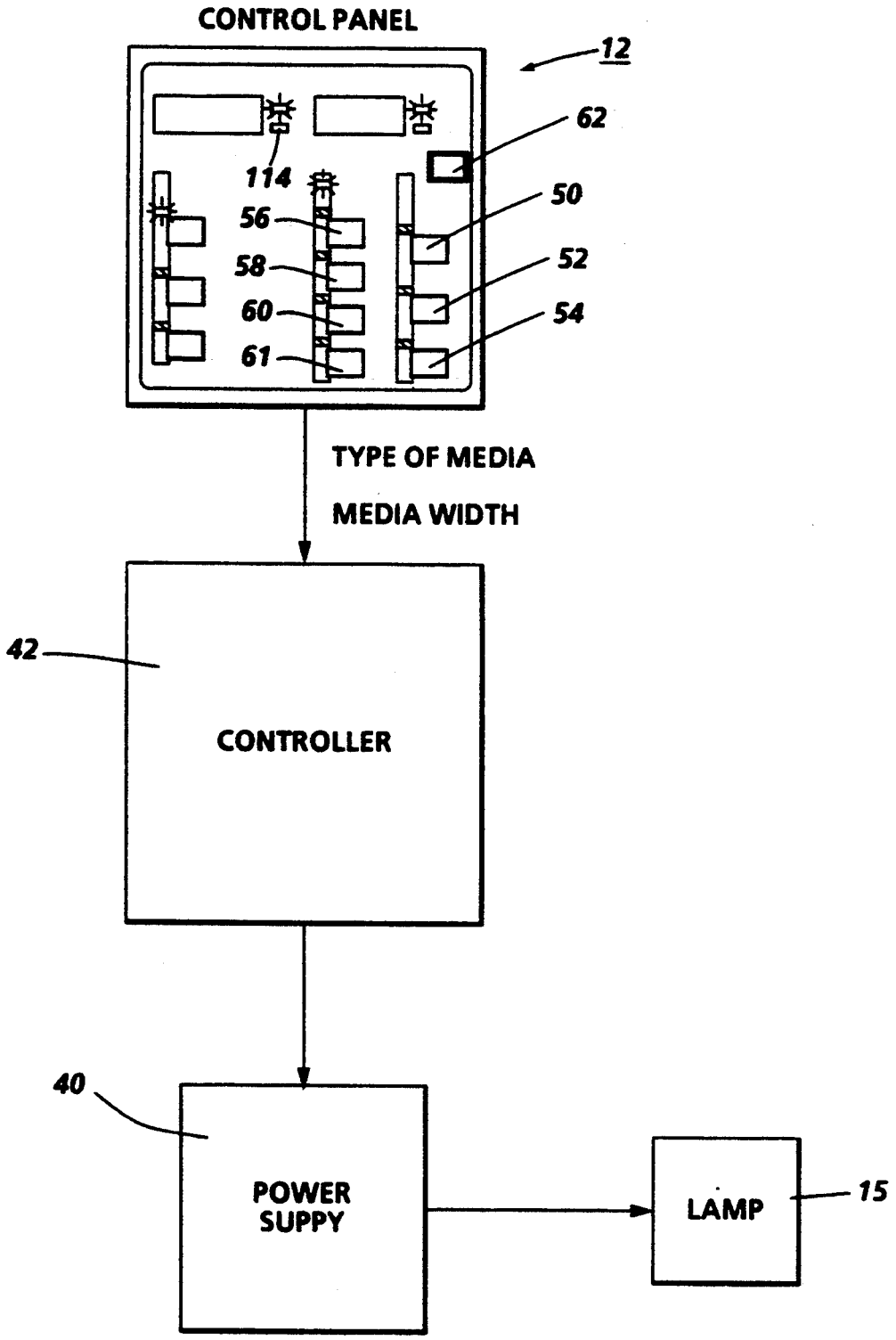
FIG. 3 is a schematic block diagram of the control system which regulates the heating temperature of the fuser system of FIG. 2.
Figure 4:
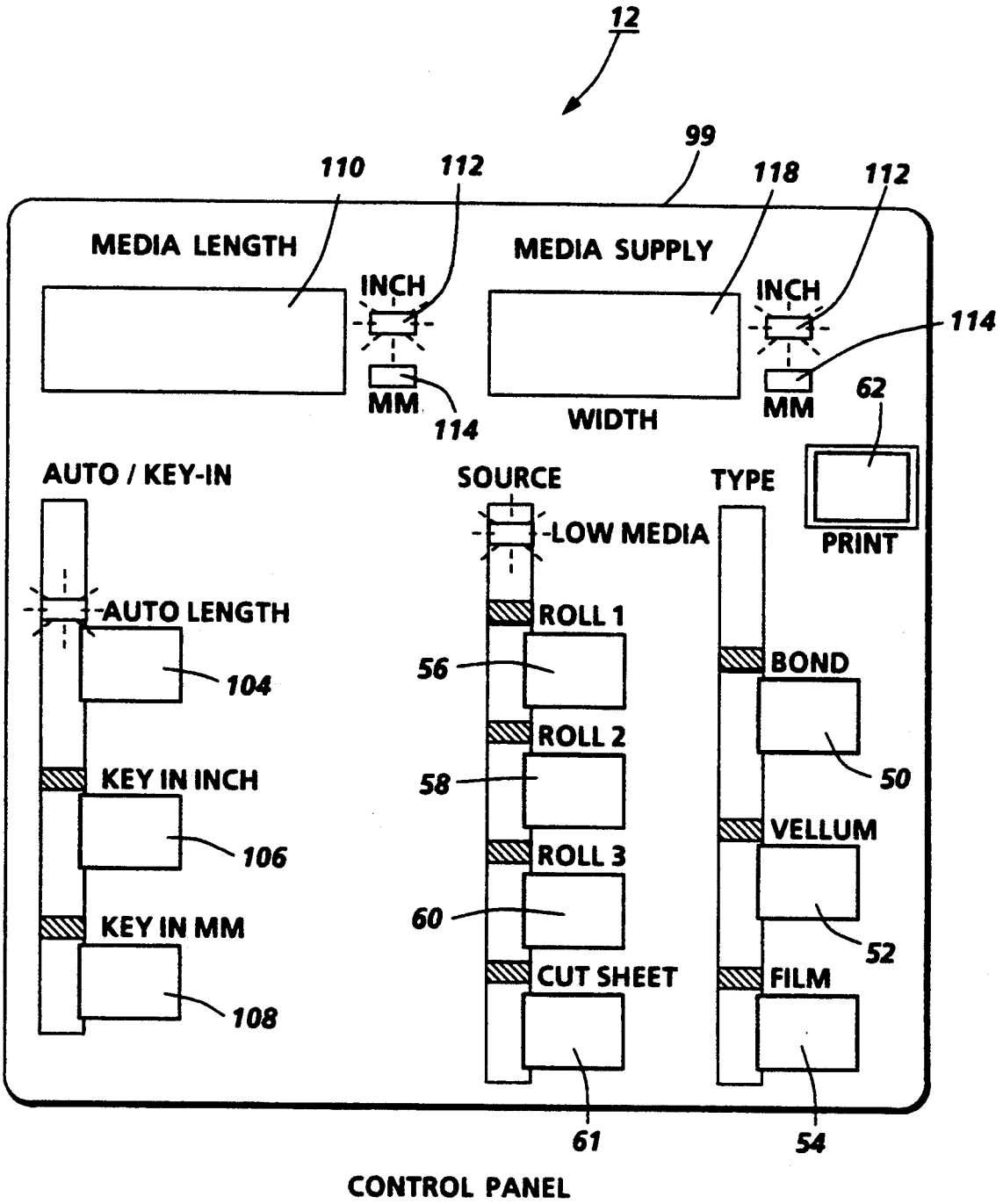
FIG. 4 is an enlarged view of the control panel shown in FIGS. 1 and 3.

Referring now to FIGS. 3 and 4, controller 42 provides for overall operation of copier 2, in response to program instructions input by the operator or user, control panel 12 being provided for this purpose. Controller 42 may be of the type disclosed in U.S. Pat. No. 4,996,556, referenced supra.

In order to describe the principles of the present invention, the following copy operation will be described. It is assumed that a copy job includes the following: 25 copies to be made of a 36 inch wide engineering drawing on bond copy media; 25 copies of the same width document on vellum and 25 copies of the same width document on film. A subsequent job is to copy 25 copies of a 24 inch document again on bond, then on vellum, then on film. Control panel 12 contains the media TYPE switches 50, 52, 54, associated with bond, vellum, and film, respectively. Switches 56, 58, 60 select rolls 30A, 30B, 30C, respectively. It is assumed that roll 30A is 36" bond, roll 30B 36" vellum and roll 30C 36" film. For this proposed example, the operator would first depress switches 50 and 56, generating media and width signals, respectively, which are sent to the controller 42. Alternatively, the media type and width may be preselected when installing the media roll into each location. For this case, the operator would simply press the desired roll switch. The operator will make other selections at the control panel relating to the number of copies, the media cutting operation, which is described in copending U.S. application Ser. No. 888,948, filed on May 26, 1992, assigned to the same assignee as the present invention and whose contents are hereby incorporated by reference.

Upon receipt of the media type and width signals from the control panel, controller 42 generates an input to power supply 40, which applies a first power level to lamp 15, causing it to heat at some optimum maximum temperature, 320° F. being selected for this example. The operator then feeds the original document into entry nip 7 where the document length is measured and stored by the techniques disclosed in U.S. Pat. Nos. 4,996,556 and 5,040,777. Thereafter, upon selection of number of copies (25 for this example) and depression of the PRINT switch 62, the document will be moved through the exposure zone to enable 25 exposures. Controller 42 controls the machine timing, registration and cutting operations. As the cut media enters the fusing station, the media width will extend across the entire width of fuser roll 14, uniformly absorbing the heat which has been transferred to the surface of roller 14 by the heat from lamp 15. The bond paper can absorb the heat at this temperature level without being overheated.

For the next copy run, the vellum copy media on roll 30B is selected (switches 52, 58). Since vellum has, among other characteristics, a lower moisture content than bond, the signal controller recognizes the vellum signal as requiring a reduction in lamp temperature to prevent overheating of the vellum. A decrease of 6° F. has been chosen to prevent vellum overheating. Hence, the power supply 40 output is reduced so as to reduce the lamp temperature to 314° F. In similar fashion, with the selection of the film roller 30C (switches 54, 60), the lamp 15 temperature is reduced by an additional 6° F. to 308° F.

Following completion of this first job of copying the 36" wide document, a 24" wide document is selected. The signals to controller 42, following operator selection at the control panel, will reflect the reduced width of the original document. In order to prevent the end overheating (overheating of the fuser roll on both sides of the center registered 24" copy sheet) the lamp 15 temperature is reduced by 20° F. and is set at 300° F., with further reductions to 294° F. for vellum and 288° F. for film. The selection of the lower temperatures requires some tradeoffs. However, the fusing temperature at that setting is still adequate for fusing purposes.

It is understood that additional combinations of media types and widths are possible. For example, media widths of 30" with a bond media would result in 310° F. being applied to the lamp. The important point is that the fuser roll temperature is now capable of being varied to that temperature which is optimum for fusing the particular combination of media type and width.

According to another aspect of the present invention, a large document printer of the type disclosed in the present embodiment may still experience overheating when narrow documents (less than 24") are being copied which exceed a certain copy media length. For example, the Xerox 2510 is capable of copying documents such as oil log records, which may exceed 25 feet in length. For this particular case, a further improvement has been made which utilizes a thermal model countdown formula to identify an overheating situation and to temporarily stop the machine processing, to allow a cooling interval before proceeding with a copy run. The formula is expressed as:

$$[(\text{seconds of copy feed})\times R]-[(\text{seconds of elapsed time})\times Y]=Z$$

where seconds of copy feed is measured from start of a copy cycle and elapsed time is continuous machine on time. The values of R and Y are initially set and are programmable. The value of Z is set so that when a certain value of Z is exceeded, indicating that the fuser roll ends are approaching an unacceptably high temperature level, the machine operation is suspended until the value of Z drops to a preset level. As an example, R and Y have initial values of 20 and 10 respectively and Z has a low value of 640 and a high value of 720, the latter being the trigger for suspended operation. As an example, at the start of a copying operation for a 45 foot document of 20" width and a process speed of 3 ips, the total copy time would take 3 minutes. Knowing the overheating characteristics of the machine when copying media of this width, it is known that, for 75 seconds of operation, an overheating condition will occur. Thus, by the formula:

$$[(75\ \text{seconds}\times 20)]-[75\times 10]=1500-750=750$$

Z has thus exceeded 720, so machine operation would be suspended when Z becomes 720. The formula works continuously, so that, at machine operation suspension, the left hand side of the equation does not change, while the right hand side continues to increase until the difference between the two is reduced to the point where Z is equal to the 640 value, at which time machine operation is resumed. It is evident that R, Y and Z have been set so that the elapsed turn off time is equivalent to allowing the temperature to decrease a given increment for each second of non-operation. Each system will have its own individualized R, Y and Z values.

While the invention has been described with reference to the structures disclosed, it is not confined to the details set forth, but is intended to cover such modifications or changes as they come within the scope of the following claims.

What is claimed is:

1. In a document copier wherein documents are imaged onto a photosensitive medium to form a latent image and wherein said latent image is developed and transferred to a copy media having a width W and a length L wherein said developed and transferred image is subjected to a fusing process, an improved fusing system for fusing said transferred image including: a fuser roll which is internally heated, means for moving said copy media into pressure contact with said fuser roll so as to fuse said image, said copy media width W being less than a width of the fuser roll, means for generating electrical signals representing the width W of the copy media being fused, and control means for recognizing said electrical signals while monitoring a copy media feed time and for predicting a media feed time which will result in an overheated condition and for automatically suspending copier operation prior to said predicted overheated condition and when fusing is still occurring along the length L of the copy media.

2. The copier of claim 1 wherein the copier operation is suspended in response to detection of a preset time interval Z, Z expressed by formula:

$$Z=\text{seconds of copy media feed}\times R-\text{seconds of elapsed time}\times Y$$

where seconds of copy media feed is measured from the start of said copy media entering into pressure contact with the fuser roller, seconds of elapsed time represents continuous copier on time and R and Y are values initially set and programmed into said control means.

* * * * *